United States Patent [19]

Fields, Jr.

[11] 4,021,642

[45] May 3, 1977

[54] OVEN EXHAUST SYSTEM FOR RANGE WITH SOLID COOKTOP

[75] Inventor: George Fields, Jr., Louisville, Ky.

[73] Assignee: General Electric Company, Louisville, Ky.

[22] Filed: Feb. 28, 1975

[21] Appl. No.: 554,198

[52] U.S. Cl. ..... 219/391; 98/48; 98/115 R; 126/21 R; 126/39 C; 126/299 R; 219/400; 312/236

[51] Int. Cl.[2] ..... H05B 1/00; F24C 15/32; F23J 11/00

[58] Field of Search ..... 219/267, 393, 400, 460, 219/463, 464, 392, 395–397; 126/21 R, 39, 21 A, 273, 299 R, 299 A, 312, 299, 273 A, 39 C, 98–115 R; 312/236; 98/48; 99/423

[56] References Cited

UNITED STATES PATENTS

| | | | |
|---|---|---|---|
| 948,629 | 2/1910 | Johnson | 98/48 |
| 951,761 | 3/1910 | Johnson | 98/48 |
| 2,158,881 | 5/1939 | McCormick | 126/21 R |
| 2,350,293 | 5/1944 | Stamchfield | 126/21 R |
| 2,376,571 | 5/1945 | Brumbaugh | 126/39 C |
| 2,408,295 | 9/1946 | Cossin | 219/395 |
| 2,586,023 | 2/1952 | Gillette | 126/21 A |
| 2,622,582 | 12/1952 | Pollock | 126/21 R |
| 2,743,719 | 5/1956 | Reeves | 126/21 R |
| 2,846,557 | 8/1958 | Schulze et al. | 219/267 |
| 3,121,158 | 2/1964 | Hurko | 219/397 |
| 3,364,912 | 1/1968 | Dills et al. | 126/21 A |
| 3,417,742 | 12/1968 | Perl | 126/21 A |
| 3,499,430 | 3/1970 | Kemp | 126/21 R |
| 3,818,171 | 6/1974 | Miller | 219/10.55 |
| 3,832,988 | 9/1974 | Doner | 126/21 R |
| 3,859,499 | 1/1975 | Evans et al. | 219/396 |

*Primary Examiner*—A. Bartis
*Attorney, Agent, or Firm*—Richard L. Caslin; Francis H. Boos

[57] ABSTRACT

An electric range having a solid glass-ceramic cooktop with a baking oven positioned beneath the cooktop. The oven includes a vertical exhaust duct joined to an oven vent means associated with the top wall of the oven and extending to an exhaust opening in the backsplash of the range. The vertical duct has a cooling air entry at its bottom portion for entry of relatively cool dry air for mixing with the oven gases prior to discharge of the oven gases from the exhaust opening. The oven vent means includes a restricted vent opening communicating with an air trap in the form of an elongated tube having a cross sectional area approximately equal to that of the restricted vent opening and extending vertically upwardly into the bottom portion of the exhaust duct a sufficient height above the air entry that the flow of hot gases through the restricted vent opening and tube increases the upward draft of cooling air and prevents backdrafts from exiting down through the air entry under both normal and oven overload conditions.

6 Claims, 2 Drawing Figures

OVEN EXHAUST SYSTEM FOR RANGE WITH SOLID COOKTOP

BACKGROUND OF THE INVENTION

1. Field of the Invention:

The invention relates to an oven exhaust system, and particularly to an exhaust system for use with an oven that is located beneath a solid cooktop.

2. Description of the Prior Art:

In a standard electric baking and broiling oven, the oven is vented through an opening in the top wall of the oven liner. An offset adapter duct joins with the oven vent opening and discharges beneath one of the rear, spiral, metal sheathed electrical resistance surface heating units of the cooktop that is mounted above the oven. One example of such a venting system for an electric range is shown in U.S. Pat. No. 3,847,135 to George R. Sherman, which is assigned to the same assignee as is the present invention.

In recent years, solid plate glass-ceramic cooktops have been used on some model ranges to replace the cooktops with metal sheathed electrical resistance surface heating units. Such glass-ceramic plates are effectively sealed across the entire top surface of the cooktop to prevent liquids from draining beneath the cooktop. This presents a problem of venting the oven.

One solution is shown in U.S. Pat. No. 3,636,309 where the oven is vented out through an exhaust grille in the lower front portion of the backsplash of the range. This patent lacks a showing of the particular duct means that are used for connecting the oven vent to the exhaust grille.

A principal object of the present invention is to provide a baking oven with an oven venting system that exits from the back edge of the oven and is provided with a cooling air entry means and an internal trap to prevent backdrafts from exiting through the cooling air entry means.

A further object of the present invention is to provide a range having a glass-ceramic cooktop with an oven venting system of the class described having a cooling air mixing facility and positive means for preventing grease laden exhaust gases from being expelled into the wiring compartment at the rear of the range.

SUMMARY OF THE INVENTION

The present invention, in accordance with one form thereof, relates to a baking oven having an oven vent opening formed in the top of the oven liner. A vertical duct means is joined to the oven vent opening and it extends upwardly to an exhaust grille for returning the exhaust gases to the kitchen atmosphere. The duct system is furnished with a cooling air entry means near the bottom portion thereof. The duct system also includes an internal trap means above the air entry means for preventing backdrafts of the oven exhaust gases from pouring out of the cooling air entry means.

BRIEF DESCRIPTION OF THE DRAWINGS

This invention will be better understood from the following description taken in conjunction with the accompanying drawings and its scope will be pointed out in the appended claims.

DESCRIPTION OF THE PREFERRED EMBODIMENT

Figure 1:
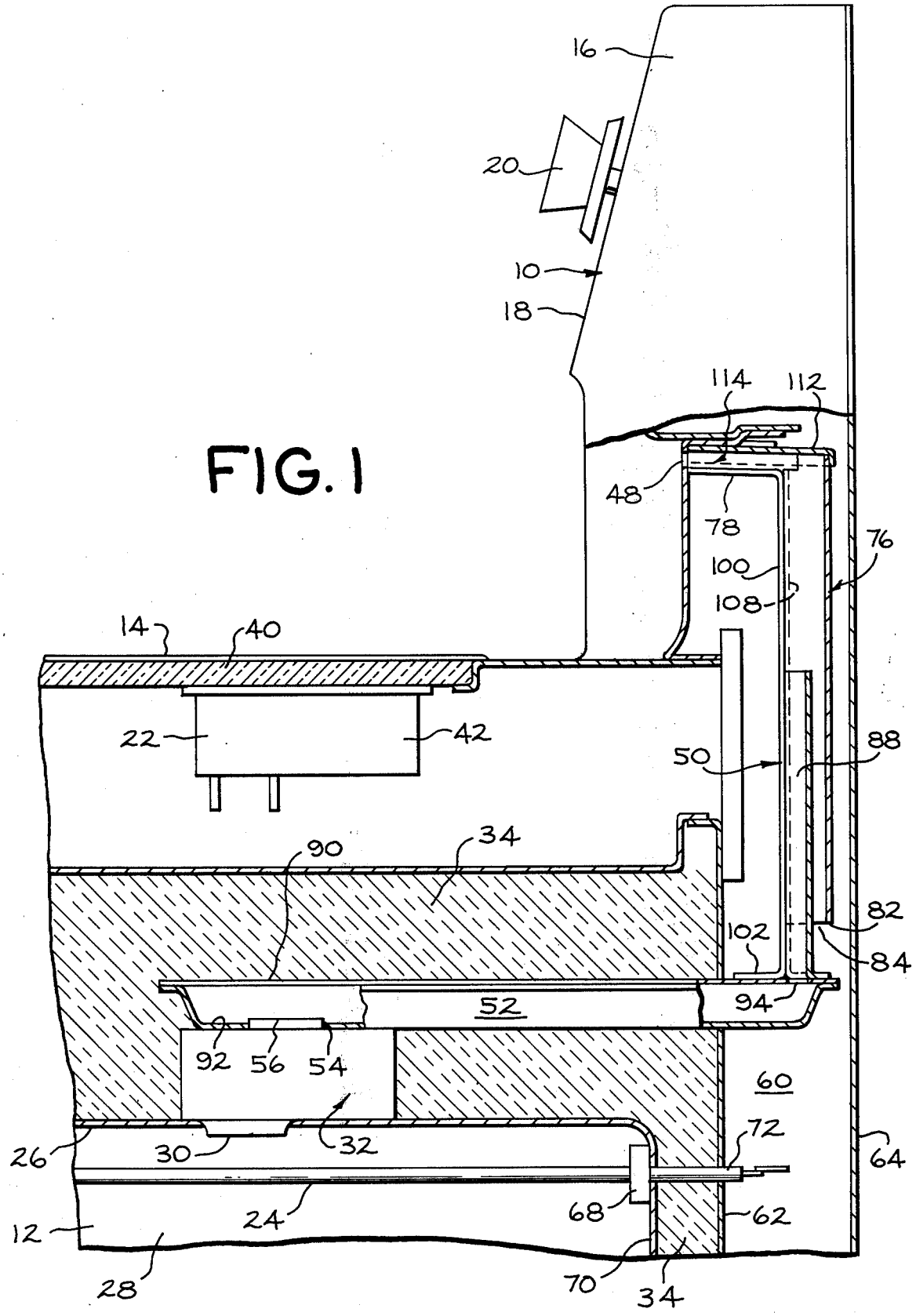
FIG. 1 is a fragmentary, cross-sectional side elevational view of an electric range taken through the top portion of the oven liner and through a solid plate cooktop assembled above the oven to show the nature of the oven exhaust system of welded construction.

Turning now to a consideration of the drawings, and in particular to FIG. 1, there is shown an electric range 10 having a baking oven 12 with a solid plate cooktop 14 assembled over the oven in a conventional manner. Arranged along the rear edge of the cooktop 14 is an upright backsplash 16 which includes an elevated front control panel 18 which supports a plurality of control components represented by a control knob 20. Such control components would serve in a conventional manner to control the operation of both the surface heating units 22 beneath the solid plate, glass-ceramic cooktop 14, as well as the oven heating means shown diagrammatically as a broil element 24 that is positioned beneath the top wall 26 of a box-like oven liner 28.

The baking oven 12 may be a standard baking and broiling oven having a lower bake element (not shown) in addition to the upper broil element 24. The oven liner 28 is furnished with a front-opening access door (not shown) which cooperates with the oven liner to form an oven cooking cavity.

This oven exhaust system of the present invention is not limited to use with an electric range, as it also may be incorporated in a gas heated oven without departing from the scope of this invention.

This baking oven 12 may also be provided with a pyrolytic self-cleaning oven cycle as is taught in U.S. Pat. No. 3,121,158 of Bohdan Hurko, wherein the walls forming the oven cooking cavity are raised to a temperature approaching 950° F for degrading the food soil and grease spatter that normally accumulate on these walls during normal baking, broiling and roasting operations. This pyrolytic degradation process produces corresponding gaseous degradation products which are exhausted to the exterior of the oven cavity so as to prevent any substantial condensation upon the oven interior walls.

The oven liner 28 includes an oven vent opening 30 adjacent the upper portion thereof. In FIG. 1 the oven vent opening 30 is located in the top wall 26 near the back wall thereof. If this oven 12 is provided with a pyrolytic self-cleaning oven cycle, it would also be provided with a smoke and odor oxidation unit 32 cooperating with the oven vent opening 30 for further degrading the oven exhaust gases into harmless gases before they are returned to the kitchen atmosphere. One example of such an oxidation unit 32 is shown in the beforementioned Hurko U.S. Pat. No. 3,121,158. A layer of thermal insulating material 34 of fiber glass or the like is assembled around the outside of the oven liner 28.

The solid plate cooktop 14 is generally of the construction as depicted in the beforementioned U.S. Pat. No. 3,636,309. There is a glass-ceramic plate 40 of a single piece to cover the entire cooktop, or it could be in two halves, or in four quarters, all as is conventional in this art. The most popular design is the single glass-ceramic plate for a group of four surface heating units 22. These surface heating units each comprise a metal container 42 supporting a cast or molded heater block (not shown) of alumina silica fiberous material or the like which carries on its top surface an open-coil resistance heating element (not shown) in spaced relation to the glass-ceramic plate 40.

Hence, it can be understood that the presence of the solid plate cooktop presents a problem as to how to handle the oven exhaust gases that are expelled through the oven vent opening 30. It is preferable to reduce the temperature and the amount of heat of the exhaust gases in order to eliminate the possibility of flesh burns when a person's hand is brought into contact with the exhaust gases. In order to protect small children, the exhaust grille 48 is located in the backsplash 16 beneath the control panel 18. Suitable ductwork 50 of sheet metal construction is designed to carry the exhaust gases from the oxidation unit 32 to the exhaust grille 48 in the backsplash. There is a first horizontal duct 52 that rests on the top of the oxidation unit 32, and it has a hole 54 in its bottom surface which fits over the collar 56 forming the exhaust opening from the oxidation unit. This horizontal duct 52 extends rearwardly of the oven and it terminates within a vertical wiring compartment 60 which is created between a recessed, vertical, rear wall 62 of the oven body, which serves to hold the thermal insulation 34 in place, and a removable cover plate 64 for gaining access to the wiring compartment 60 when the need arises. Notice that the broil element 24 has a mounting plate 68 joined to the rear wall 70 of the oven liner 28, and that the broil element has its terminals 72 extending out through the insulating layer 34 and rear wall 62 into the wiring compartment 60 where suitable lead wires (not shown) would be joined thereto for completing the necessary power circuits to the heating means.

Cooperating with the horizontal duct 52 is a vertical duct 76, located within the wiring compartment 60, for extending above the cooktop 14 and terminating in a front-turned horizontal extension 78 for connecting the vertical duct 76 to the exhaust grille 48. The bottom end 82 of the vertical duct 76 is not sealed to the horizontal duct 52; but instead, is spaced upwardly therefrom to create a cooling air entry means 84 from the wiring compartment 60. There is a telescopic tube 88 which is joined to the horizontal duct 52 and it extends upwardly into the vertical duct 76 for a relatively large distance greater than about 3 inches. This distance is shown as greater than one-half the length of the vertical duct 76. This telescopic tube 88 forms an air trap within the vertical duct 76 above the cooling air entry means 84 so the exhaust gases expelling from the tube 88 may not reverse their direction and exit through the cooling air entry means 84. If this backdraft action had not been prevented, the water vapor and grease particles present in the exhaust gases might otherwise condense onto exposed electrical conducting terminations within the wiring compartment 60 and cause malfunctions. The telescopic tube 88 serves as an aspirator to create a partial vacuum or suction action within the vertical duct 76 so as to increase the flow of dry cooling air up through the bottom of the vertical duct for mixing with the hot exhaust gases for a sufficient time before the gas mixture is expelled from the exhaust grille 48.

Figure 2:
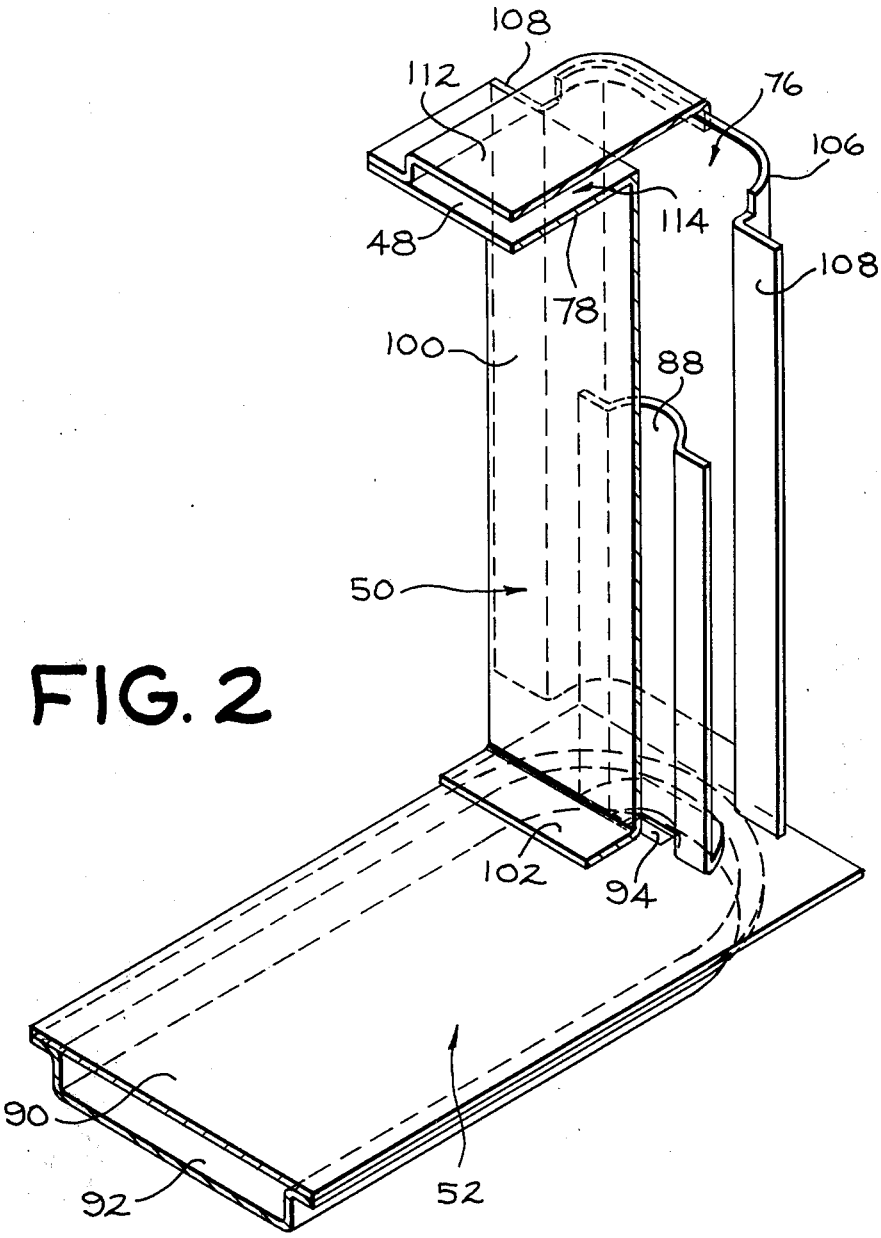
FIG. 2 is a fragmentary perspective view of the horizontal and vertical exhaust duct sections which cooperate to form the oven exhaust system of FIG. 1.

The duct work 50 is constructed of sheet metal shapes as simple as can be devised. For example, the horizontal duct 52 is formed by a flat top plate 90 covering an elongated shallow pan 92, as is best seen in FIG. 2. The rear end of the top plate 90 is provided with a small rectangular opening 94.

The vertical duct 76 has a flat plate 100 with a front-facing horizontal flange 102 at its lower end that is fastened to the top plate 90, as by welding. The upper end 78 is also turned forward to reach to the exhaust grille 48. Cooperating with the flat plate 100 is a shallow, elongated channel member 106 which has oppositely facing flanges 108, 108 that bear against and are attached to the flat plate 100. As mentioned earlier, the bottom edge 82 of this channel member 106 is spaced above the top wall 90 of the horizontal duct 52 to create the cooling air entry means 84. A top cover plate 112 of shallow inverted channel design is supported on the upper end 78 of the flat plate 100 of the vertical duct 76. This top cover plate 112 serves to cap the top of the vertical duct 76 and also cooperates with the upper end 78 to form a forwardly facing horizontal duct 114 which terminates at the exhaust grille 48.

In many models of pyrolytic self-cleaning ovens there is provided a forced ventilating air cooling system circulating cool air between the insulating oven liner and the outer oven or range cabinet or body, so as to hold down the exterior temperature of the oven or range. Such a forced ventilating system would augment the oven exhaust system of the present invention by sending a greater quantity of cool air up through the wiring chamber 60 and through the cooling air entry means 84 for mixing with the hot exhaust gases.

Modifications of this invention will occur to those skilled in this art, therefore, it is to be understood that this invention is not limited to the particular embodiment disclosed, but that it is intended to cover all modifications which are within the true spirit and scope of this invention as claimed.

I claim:

1. A baking oven comprising an outer cabinet and internal walls forming an oven cooking cavity, heating means for raising the temperature within the cooking cavity, said cooking cavity including an oven vent means with a restricted vent opening the outer cabinet including a vertical duct means joined to the oven vent means and extending upwardly to an exhaust opening in the top portion of the outer cabinet for returning the oven gases to the atmosphere, the said vertical duct means having a cooling air entry means adjacent its bottom portion for mixing relatively dry cool air with the oven gases before the oven gases are expelled from the exhaust opening, the vertical duct means also including an elongated telescopic air trap means adjacent its bottom portion communicating with said vent opening, the cross-sectional area of said telescopic air trap means being approximately equal to that of said restricted vent opening, the said elongated telescopic air trap means comprising a vertical elongated tube extending up into the bottom portion of the said vertical duct means for a sufficient height above the bottom cooling air entry means that the flow of hot gases through said restricted vent opening and telescopic air trap means increases the upward draft of the cooling air and prevents backdrafts from exiting down through the cooling air entry means under both normal and oven overload conditions.

2. A baking oven as recited in claim 1 wherein the said oven vent means is associated with the top wall of the oven cooking cavity said vent means includes horizontal duct means having said restricted vent opening at its rear end.

3. A baking oven as recited in claim 3 wherein the said vertical elongated tube of the air trap has a height greater than about 2 inches above the bottom cooling air entry means.

4. A baking oven as recited in claim 1 wherein the said elongated telescopic air trap means of the vertical duct means comprises a tube of small cross-sectional area compared to the cross-sectional area of the vertical duct means so as to send a high velocity, high temperature, low pressure jet of oven air up the vertical duct so as to draw a strong flow of cooling air up through the bottom cooling air entry means and prevent a reversal of this upward cooling air flow.

5. A baking oven as recited in claim 1 wherein the said oven heating means comprise electrical resistance heating elements having electrical terminals at the back of the oven cabinet and beneath the said vertical duct means.

6. A baking oven as recited in claim 5 wherein a solid plate cooktop is mounted over the top of the oven.

* * * * *

UNITED STATES PATENT AND TRADEMARK OFFICE

CERTIFICATE OF CORRECTION

PATENT NO. : 4,021,642

DATED : May 3, 1977

INVENTOR(S) : George Fields, Jr.

It is certified that error appears in the above-identified patent and that said Letters Patent are hereby corrected as shown below:

Claim 3, line 3, "2 inches" should be "3 inches".

Signed and Sealed this

*thirtieth* Day of *August 1977*

[SEAL]

*Attest:*

RUTH C. MASON
*Attesting Officer*

C. MARSHALL DANN
*Commissioner of Patents and Trademarks*